US007147083B1

(12) United States Patent
Colgrove

(10) Patent No.: US 7,147,083 B1
(45) Date of Patent: Dec. 12, 2006

(54) SUPPORT APPARATUS

(75) Inventor: Mark R. Colgrove, 310 Cherry St., Oxford, NC (US) 27565

(73) Assignee: Mark R. Colgrove, Oxford, NC (US)

( * ) Notice: Subject to any disclaimer, the term of this patent is extended or adjusted under 35 U.S.C. 154(b) by 170 days.

(21) Appl. No.: 10/814,562

(22) Filed: Mar. 31, 2004

Related U.S. Application Data

(60) Provisional application No. 60/458,534, filed on Mar. 31, 2003.

(51) Int. Cl.
*E04G 1/34* (2006.01)

(52) U.S. Cl. ..... 182/153; 182/181.1; 248/200

(58) Field of Classification Search ..... 248/127, 248/188, 188.1, 158; 182/181.1, 186.5, 151, 182/153, 155, 225, 224, 186.8, 186.2
See application file for complete search history.

(56) References Cited

U.S. PATENT DOCUMENTS

| | | | | | |
|---|---|---|---|---|---|
| 145,174 | A | * | 12/1873 | Harden | 248/163.1 |
| 563,309 | A | * | 7/1896 | Reeves | 182/153 |
| 5,427,200 | A | * | 6/1995 | Yemini | 182/153 |
| 5,678,655 | A | * | 10/1997 | Bearden | 182/182.1 |

* cited by examiner

*Primary Examiner*—Ramon O Ramirez
(74) *Attorney, Agent, or Firm*—Richard Z. Polidi

(57) ABSTRACT

An improved support apparatus for use in many manufacturing operations. The improved apparatus may be used as a workbench having an open upper region to assist in such operations as drilling and cutting. The apparatus can accommodate a large variety of sizes and shapes of workpieces and comprises a highly portable unit.

17 Claims, 17 Drawing Sheets

SUPPORT APPARATUS

RELATED APPLICATION

This application claims the priority of U.S. Provisional Application No. 60/458,534, filed Mar. 31, 2003, the contents of which are incorporated by reference.

FIELD OF THE INVENTION

The present invention relates generally to a versatile support apparatus. More specifically, the invention relates to an improved portable workbench having an upper frame and coplanar support elements to create an open upper work region for assisting in many manufacturing processes.

BACKGROUND OF THE INVENTION

A variety of support structures for assisting in manufacturing and fabrication operations are known. A simple worktable with a rigid support framework and a solid upper surface is common. Several worktable configurations are available for use in such processes as assembly, grinding, welding, and the like. However, other processes such as drilling and cutting (e.g., cutting with a circular saw) are more easily performed on a support structure having a support surface with open spaces therein as well as attached clamping means.

A support structure having an upper surface with open spaces suitable for assisting in drilling or cutting through a workpiece may be less common. One solution for fabricators is to lay two or more beams parallel to each other upon a solid surface, e.g., upon a worktable or on the ground. The beams create an open upper work surface suitable for cutting and drilling processes. The beams may be positioned to provide space therebetween and also between the upper work surface provided by the beams and the lower surface on which the beams rest. The open spaces advantageously allow a user to cut or drill through a workpiece without damaging either the tool or the lower surface. While such a method may suffice for some fabricators, laying and using beams on a worktable or the ground may be inconvenient. A worktable may be too small to support the beams securely or too large to be portable. The ground may be wet or dirty, and working on the ground may require a fabricator to kneel in an uncomfortable position. An insufficient amount of space between the upper and lower surfaces may result in damage to the tool and to the lower surface. Using larger beams to create a greater vertical space may create further inconvenience by requiring additional effort to manipulate the larger and heavier beams. In order to support a workpiece such that all portions are fully supported immediately after a severing cut is made, a fabricator would need to use at least four parallel beams, at least two beams under each severed portion. However, it is difficult (if not impossible) to form a coplanar upper work surface with the additional beams, unless the lower surface is almost perfectly flat and the beams are uniform.

Another solution is to use sawhorses. A sawhorse is a portable support structure typically having a narrow top horizontal beam and four divergent legs, physically similar to a trestle. Two sawhorses are used in combination to provide support to a workpiece in two regions thereof with an open space therebetween. A fabricator typically positions the two sawhorses parallel to each other and lays the workpiece thereon, e.g., for sawing with a circular saw. A fabricator generally saws on the side of a sawhorse opposite the other sawhorse rather than between the two sawhorses, allowing the unsupported section of the workpiece to fall to the ground after the cut is made.

While using a pair of sawhorses is helpful when cutting small pieces from a workpiece, this method may result in splintered cuts for larger pieces. Specifically, an unsupported portion may begin to fall before a cut is completed, causing the wood to splinter. In order to make a cleaner cut, several methods of using sawhorses for fully supporting both sides of a workpiece are known and may be advantageous when sawing a large panel of plywood or a long section of lumber. For example, the sawhorses may be arranged in different configurations, such as perpendicular to each other. A "sacrificial piece" may be mounted on top of each sawhorse to provide an enlarged work support surface, where the sacrificial piece may be cut together with the workpiece. However, such methods have disadvantages. Arranging sawhorses perpendicular to each other may increase the difficulty of creating a level and coplanar work surface, and the processes of making, attaching, and replacing "sacrificial pieces" are time consuming and may be inconvenient.

Using more than two sawhorses is sometimes desirable to a fabricator. Additional sawhorses provide extra support to a workpiece and may support it fully on both sides of a cut as a fabricator is sawing. Additional sawhorses may also be arranged in a greater variety of configurations to accommodate workpieces with many shapes and sizes. However, it is typically not feasible to use more than two sawhorses and simultaneously achieve coplanar work supports. Specifically, the top beams of the sawhorses may not be coplanar. As a result, insufficiently supported items may be unstable and may shift during use. Manufacturing processes may be performed with less accuracy. The risk of injury may increase if a dangerous manufacturing process with a sharp tool is performed or if a heavy item falls. One or more sawhorses may even tip over during use, particularly in view of their relatively narrow footprints. The foregoing concerns are especially relevant on many construction sites where flat ground may be difficult to find.

Improved support structures for assisting in such manufacturing processes as drilling and cutting have been developed. For example, U.S. Pat. No. 3,615,087 to Hickman discloses a workbench having a pair of top members in substantially the same plane with a gap therebetween, increasing the convenience of such processes as cutting through lumber. Integral clamping devices are used to open and close the central gap. However, supporting larger workpieces on the Hickman workbench, e.g., supporting a long beam of lumber for a transverse cut where both sides are fully supported both before and after the cut, may be difficult. Clamping a long beam to the work surface for a transverse cut requires additional clamping means and would be inconvenient and time consuming. The overall width of the structure may be adjusted by only a small amount for clamping purposes. Only two support panels, namely the pair of top members, provide the entire surface for supporting a workpiece.

U.S. Pat. No. 5,421,430 to Cox discloses a support structure comprising a collapsible sawhorse having an upper body portion and a plurality of detachably securable legs. An elongated, longitudinally extending gap facilitates such processes as cutting through lumber. Similar to the Hickman workbench, the surface for supporting a workpiece includes only two support panels and may be insufficient for several processes. Also, the width of the device is fixed. While a fabricator may use two or more of the Cox sawhorses of Hickman devices to provide additional work surface, challenges similar to those with standard sawhorses still exist, namely those associated with keeping their support surfaces coplanar.

It would be advantageous to provide an improved support structure for assisting in cutting and drilling, where the structure can accommodate a larger variety of sizes and shapes of workpieces, can provide multiple coplanar work support surfaces, and can comprise a highly portable unit.

SUMMARY OF THE INVENTION

The support apparatus of the present invention provides many advantageous features for a variety of purposes. The apparatus has a width that may be easily adjusted to virtually any magnitude desired by a fabricator to create an upper work region for accommodating workpieces having many different shapes and sizes. The improved upper work region has multiple elevated support elements which may be positioned as needed to provide open spaces therebetween. The open spaces assist in cutting and drilling processes without any hindrances whatever. In a preferred embodiment, at least two integral support elements may be used in combination with a plurality of additional support elements. In accord with an important feature of the invention, all support elements may advantageously be coplanar. The additional coplanar support elements are particularly useful for supporting larger workpieces for cutting and drilling and may fully support large workpieces on both sides of a cut during a cutting operation. The possibility of splintering is eliminated. Each support apparatus preferably includes two support frames, and extra support frames may be interconnected therewith to form support configurations having additional shapes and sizes. Importantly, the additional configurations may also have coplanar work surfaces. The support apparatus of the present invention is highly portable, and it may be erected and broken down without the use of tools. It may be erected to form a rugged and stable yet open work surface which may be easily expanded, and it may be broken down into a compact unit. It may be manufactured with excellent economy.

In accordance with a preferred embodiment of the present invention, two specially configured support frames are rigidly connected to each other by means of two horizontal linking members. The horizontal linking members may be beams of lumber having common cross-sectional dimensions, and virtually any lengths thereof may be used in order to provide the desired spacing between the frames. Moreover, because the linking members have common cross-sectional dimensions, additional linking members with different lengths may be easily obtained from virtually any lumber retailer. The frames may be spaced apart by any distance up to the lengths of the linking members for providing the desired width for the upper work region. Specially configured engagement means have been developed for fastening the linking members to the support frames. In a preferred embodiment of the invention, placing a load upon the apparatus tightens the connections between the linking members and the support frames by creating "gripping" force couples. When present, such force couples restrict all movement of the linking members relative to the support frames, including rotation and translation (e.g., shifting within the engagement means). The present configuration results in a very stable and safe construction. Furthermore, when the apparatus is not loaded, the "gripping" couple is minimal and a user may conveniently remove the linking members from the support frames.

Each support frame preferably has at least one integral support element having an upper surface above those of the linking members for supporting a workpiece or the like thereon. The support frames and linking members together form an upper frame with an open upper work region, wherein the top surfaces of the integral support elements are coplanar with each other in an upper plane and the top surfaces of the linking members are coplanar with each other in a lower plane. To particular advantage, additional support elements which are typically unattached may be easily positioned upon the linking members. The additional support elements are sized and shaped so that their upper surfaces are coplanar with the upper surfaces of the integral support elements. The additional support elements may be moved easily from one position to another along the lengths of the linking members while remaining coplanar with each other and with the integral support elements.

The foregoing configuration advantageously provides a plurality of easily movable support elements with upper support surfaces that are coplanar. Using the apparatus is therefore similar to using a plurality of sawhorses, yet obviates the difficulty of achieving coplanar work supports. Specifically, all the support elements of the present invention are held in a single upper plane with open spaces therebetween. In addition, the support elements are more easily and more rapidly movable than multiple sawhorses would be. In accordance with a preferred embodiment of the invention and because of the linked configuration, the erected support apparatus is particularly stable and may also be easily transported as a single unit rather than as multiple separate sawhorses, providing increased convenience on a jobsite. The apparatus also may be conveniently transported together with any workpieces thereon, eliminating the need to remove the workpieces, transport each sawhorse individually, and then transport and replace the workpieces.

In a particularly preferred embodiment of the present invention, each support frame is a rigid structure consisting of two top rails, two bottom rails, and two legs. Each of the four rails is attached to both legs, increasing the rigidity of the frame. Engagement means to hold the linking members securely in place may be provided by the top and bottom rails. The linking members preferably have rectangular cross sections, whereby each linking member may be inserted easily between the top and bottom rails for a tight fit. Once a linking member is inserted and the apparatus is loaded, the two top and two bottom rails grip the linking member securely therebetween by applying a "gripping" couple thereto. The engagement means therefore restricts an attached linking member from moving with respect to the rails (as well as to the respective frame) when the apparatus is loaded.

The two top rails further provide integral support elements for supporting a workpiece or the like thereon. The entire upper surfaces of two (or more) interconnected frames, including the "dual" upper surfaces of the top rails and the upper surfaces of the legs, provide ample surface area to support many types and sizes of workpieces. Because the upper surfaces of the frames are higher than the upper surfaces of the linking members, a completely open region is provided between the frames. Therefore, e.g., a fabricator may cut a workpiece with a circular saw across the entire depth of the apparatus, without cutting through the linking members or any other obstacles below the workpiece. In accordance with the present embodiment, the configuration of the rails permits the apparatus to be erected and broken down with ease and without tools. One frame may conveniently be nested with the other such that the legs of one frame are inserted between the rails of the other frame to provide a compact and lightweight unit. Short linking members, as well as additional support elements, may also be inserted between the rails of both nested units, providing a highly portable unit.

The rails are preferably rigidly fastened to the legs, e.g., with screws as well as an adhesive. Such a configuration provides a very rigid structure capable of supporting substantial loads without any need for additional gussets or the like, in turn simplifying the manufacture thereof. The two frames, held together by the linking members, provide a substantially larger footprint than that of an individual sawhorse, resulting in excellent stability. Moreover, a single erected apparatus of the present invention provides the functions of two or more standard sawhorses. Specifically, each of the two support frames can provide the functions of a sawhorse, and each additional support element can effectively serve as an additional, coplanar sawhorse. The support frames and linking members are held together such that the integral support surfaces of each frame are fixed in a coplanar arrangement, unlike sawhorses which instead are independent of each other and therefore not rigidly connected. At the same time, the present apparatus has a total of four legs, providing a more stable support structure than two sawhorses, which instead have eight legs and are therefore affected more by an irregular ground. Further features and advantages of the invention will become apparent from the detailed description in connection with the following figures.

BRIEF DESCRIPTIONS OF THE DRAWINGS

For a complete understanding of the above and other features of the invention, reference is made to the following detailed description and the accompanying drawings, wherein.

Figure 22:
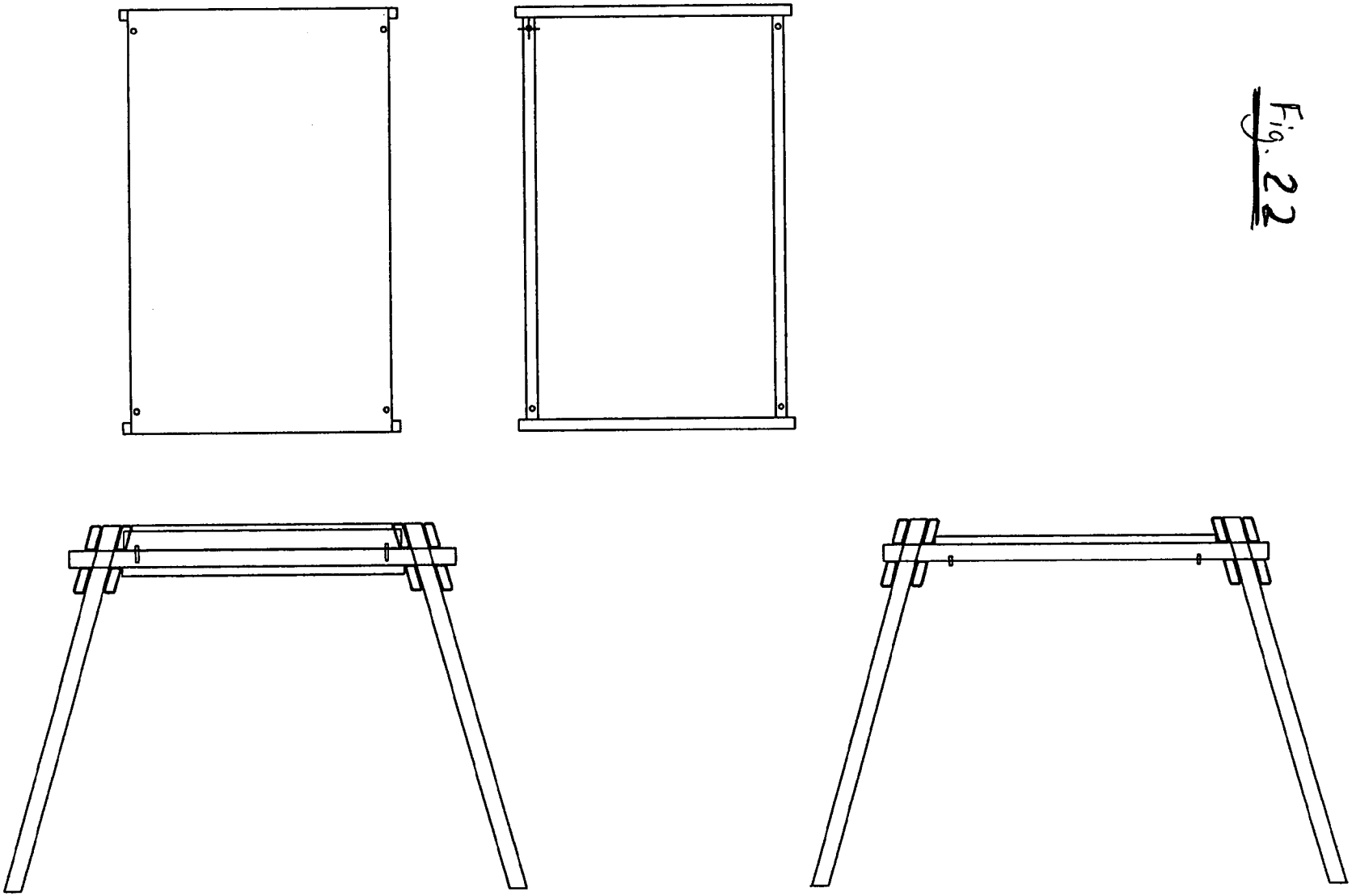

FIG. 22 includes orthogonal views of a tool tray of the present invention.

Figure 23:
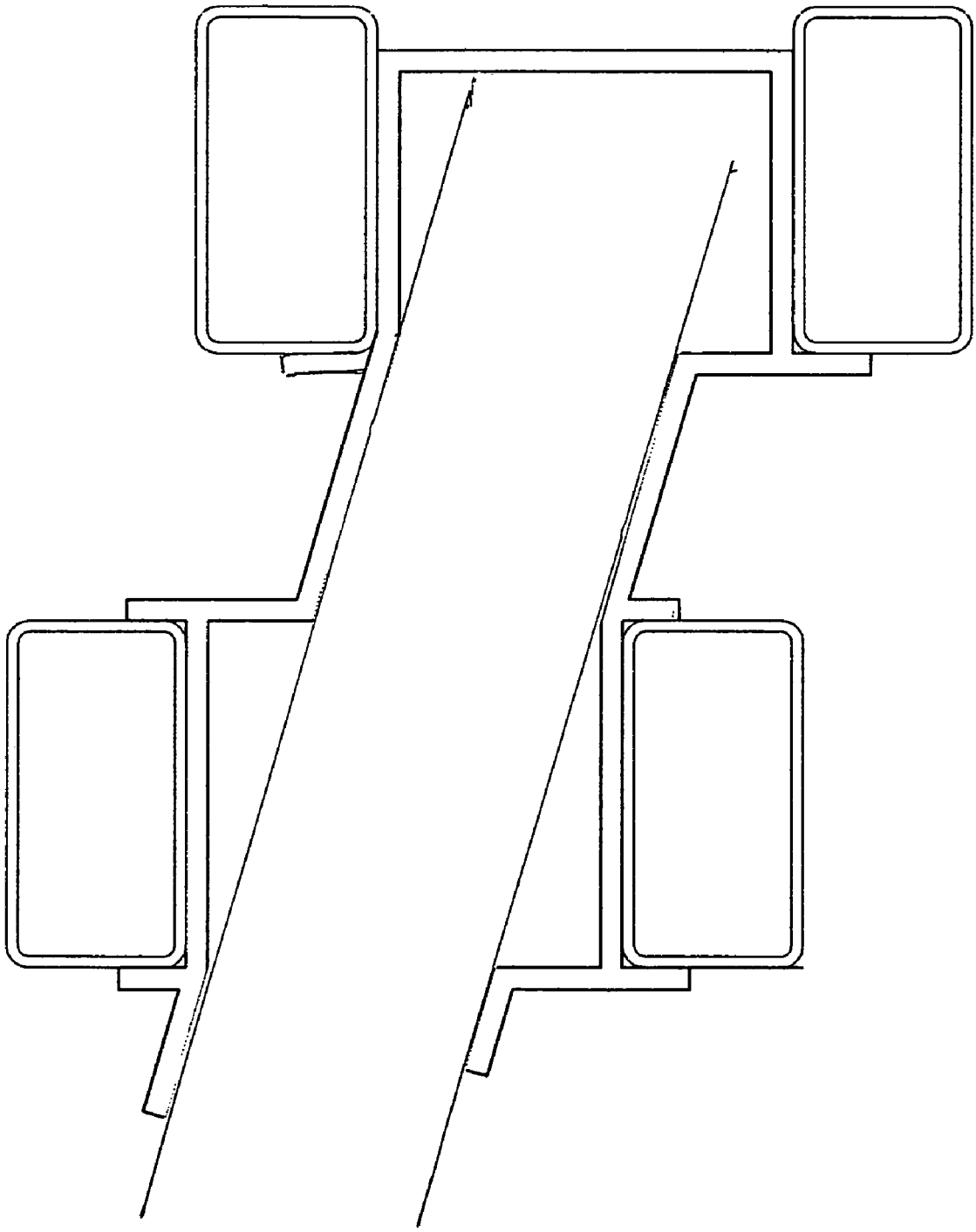

FIG. 23 is a front view of an extrusion for supporting the rails of the present invention.

Figure 24:
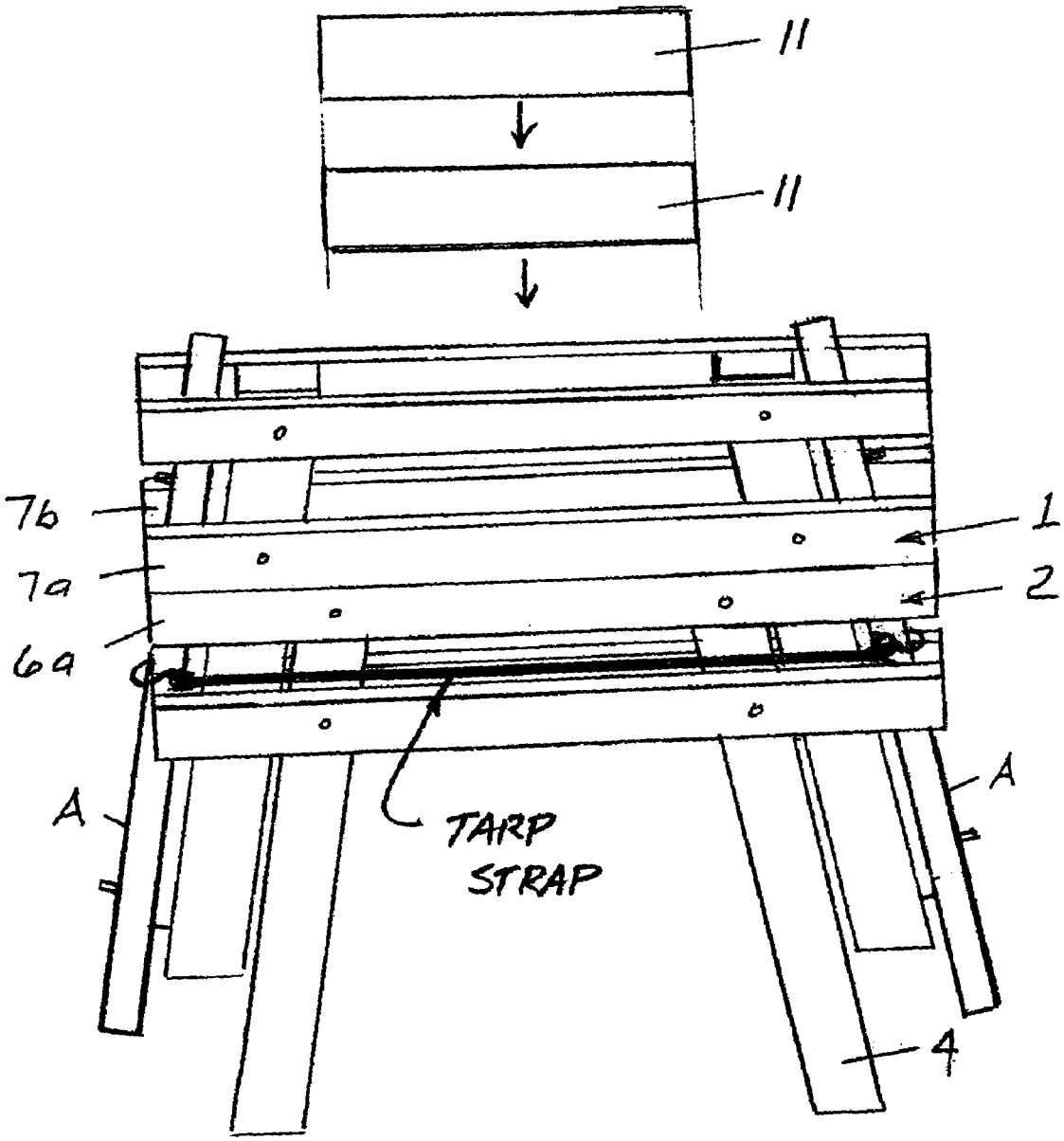

FIG. 24 is a perspective view of a nested unit of the present invention; wherein a single tarp strap is holding the unit securely together.

DETAILED DESCRIPTIONS OF THE PREFERRED EMBODIMENTS

In accordance with a preferred embodiment of the present invention; an improved support apparatus is provided. The apparatus is preferably modular, providing a structure that a user may easily assemble at a jobsite and may easily break down into a compact unit for convenient transport and storage. It may include few parts for fast assembly as well as economical manufacture. The apparatus may include an upper frame with an open upper work region to assist in such operations as cutting, drilling, and the like. To particular advantage, a plurality of support elements may be provided to form a planar upper work surface which provides ample support to larger workpieces. The apparatus is versatile and may be used for a large variety of purposes and to form a large variety of structural configurations.

Figure 1:
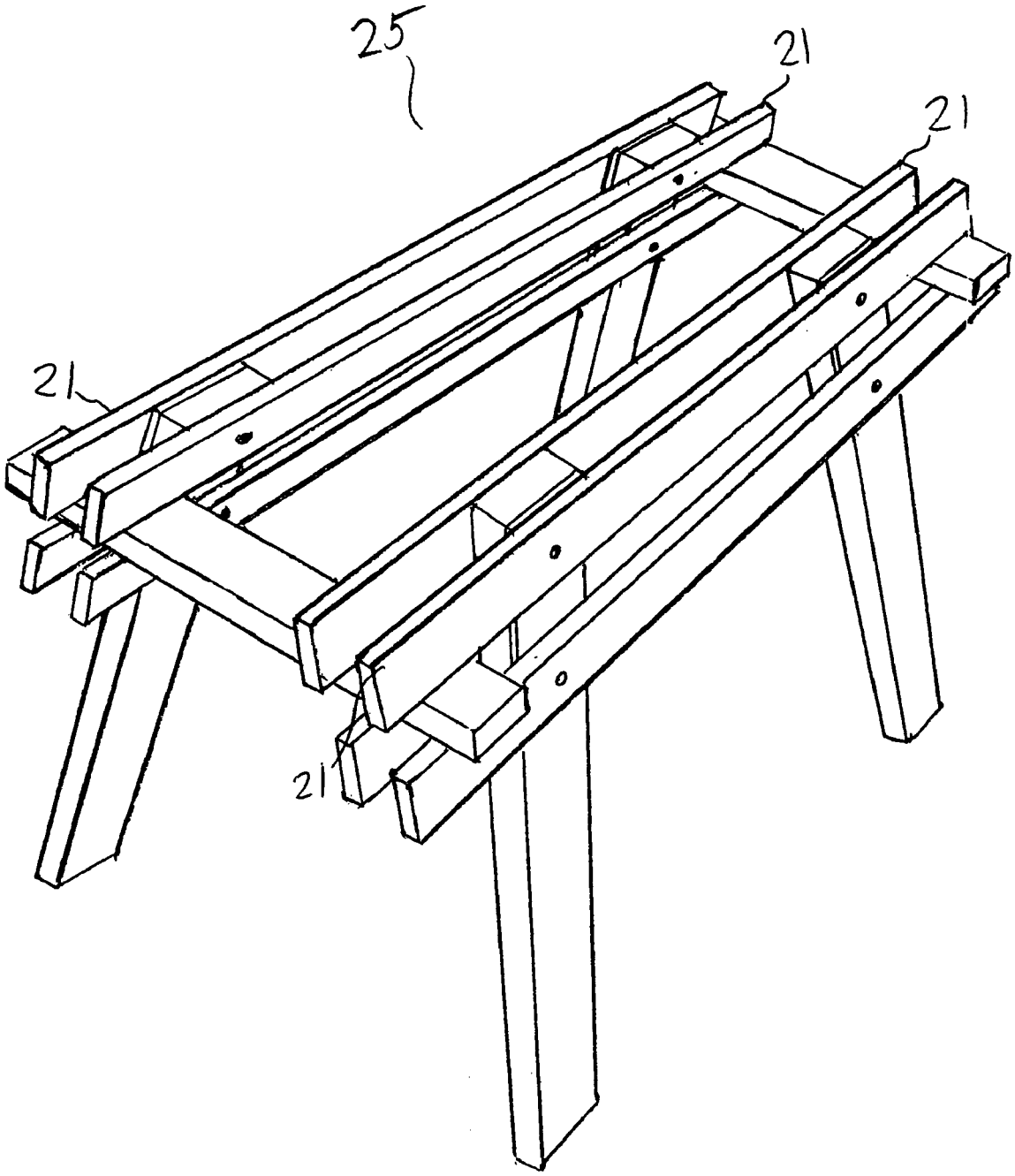
FIG. 1 is a perspective view of a preferred embodiment of an erected support apparatus of the present invention.
Figure 2:
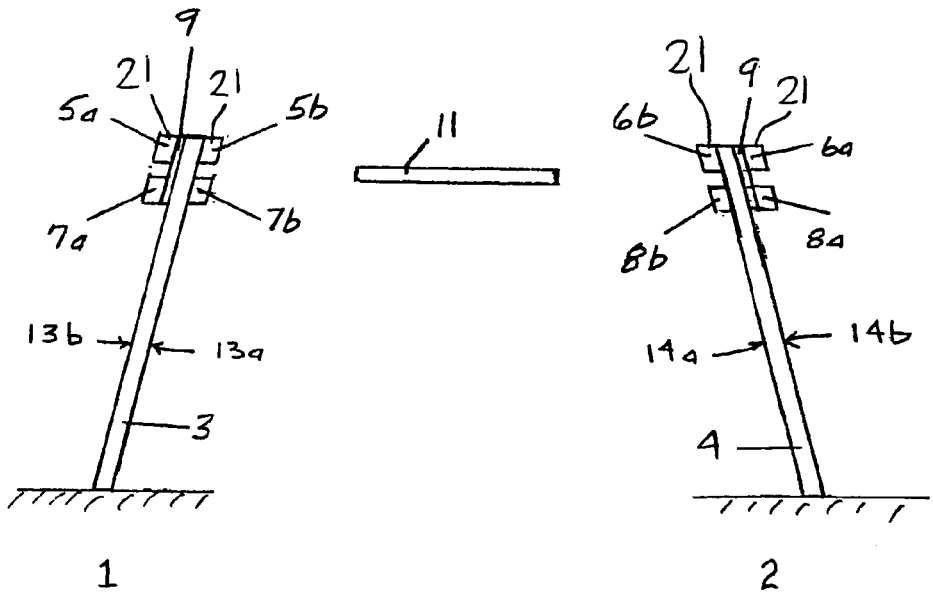
FIG. 2 is an exploded view of the support apparatus embodiment of FIG. 1 showing support frames and a linking member.
Figure 3:
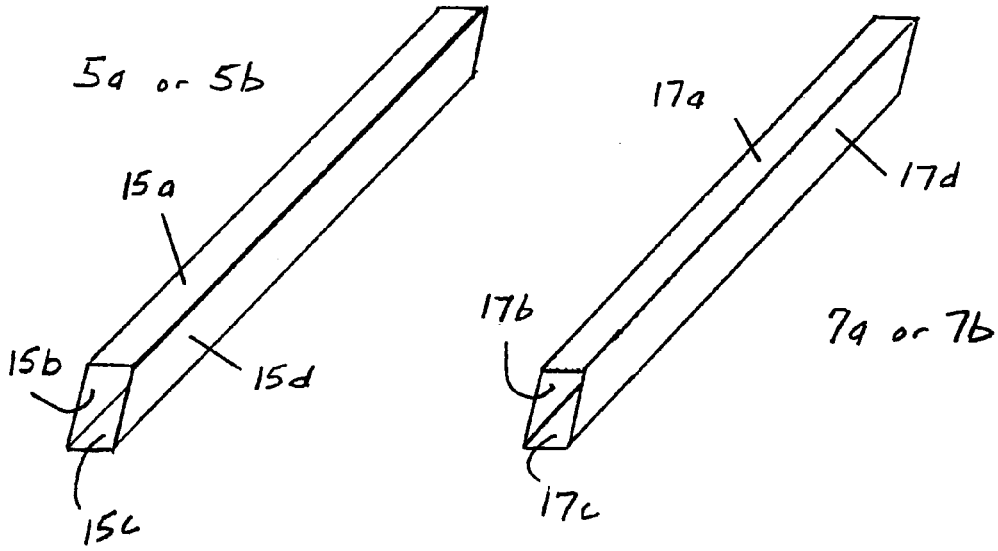
FIG. 3 is a perspective view of rails of a preferred embodiment of the support apparatus of the present invention.

As shown in FIGS. 1–3, a preferred embodiment of the support apparatus of the invention, referred to generally by the reference numeral 25, includes a first support frame (1) and a second support frame (2). Linking members (11) connect the two support frames (1, 2) together when the support apparatus (25) is erected and ready for use. The linking members (11) can be long or short, depending on the desired width by which the user wishes to space apart the support frames (1, 2), providing a very large variety of widths for use with workpieces of many difference sizes. The present embodiment may be advantageously manufactured entirely from wood. Each support frame (1, 2) may be held together with metal lag screws and, preferably, an adhesive for added rigidity. It can be appreciated that the apparatus can be manufactured by a fabricator with relative ease, e.g., in a workshop using commonly available materials and tools without the need for more complex manufacturing equipment.

In accordance with a preferred embodiment, a first support frame (1) includes two legs (3) and a second support frame (2) includes two legs (4). All four of the legs (3, 4) preferably have identical dimensions. The legs (3) of the first frame (1) are rigidly connected by two outer rails (5*a*, 7*a*) and two inner rails (5*b*, 7*b*). The legs (4) of the second frame (2) are connected by two outer rails (6*a*, 8*a*) and by two inner rails (6*b*, 8*b*). All eight rails preferably have identical dimensions in order to minimize production costs. Each of the legs and rails has two end surfaces and four side surfaces. The legs preferably have rectangular cross sections, while the rails have non-rectangular cross sections. As shown in FIG. 3, the preferred cross sections of the rails instead form parallelograms having two acute and two obtuse angles at their corners. When the apparatus is erected for use, the upper and lower surfaces (15*a*, 15*c*) of the top rails (5*a*, 5*b*) and the upper and lower surfaces (17*a* and 17*c*) of the bottom rails (7*a*, 7*b*) of the first support frame (1) are coplanar with the corresponding surfaces of the rails (6*a*, 6*b*, 8*a*, and 8*b*) of the second support frame (2). The other rail surfaces (e.g., 15*b*, 15*d*) of both frames are parallel with the plane containing the legs to which the respective rails are attached.

Figure 4:
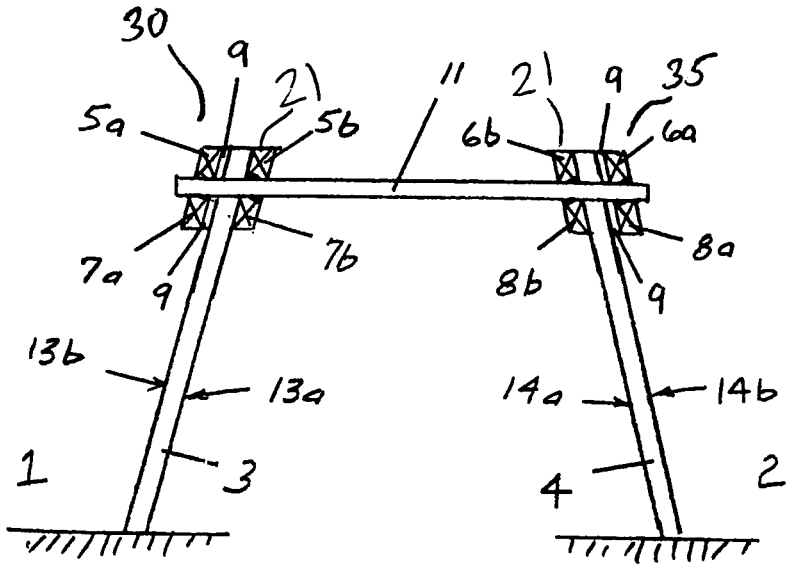
FIG. 4 is a front view of the support apparatus embodiment of FIG. 1.

As shown in FIGS. 2–4, the top rails (5*a*, 5*b*, 6*a*, 6*b*) provide integral support elements 21 for supporting a workpiece. To particular advantage, the upper surfaces of all of the upper rails of each support frame (1, 2) are coplanar with each other and with the top surfaces of all four legs, resulting in a very useful upper work surface for securely supporting a workpiece or the like. The spacing of the support frames may be adjusted to accommodate many different shapes and sizes of workpieces. When there is no spacing between the frames, the upper work surface may also provide a convenient and stable stepping platform.

As shown in FIGS. 1–5, the outer surfaces (15*b*, 17*b*) of the inner rails (5*b*, 7*b*) are preferably flush against the inside faces (13*a*) of both legs (3) of the first support frame (1). Similarly, the outer surfaces of the inner rails (6*b*, 8*b*) of the second support frame (2) are preferably flush against the inside faces (14*a*) of the respective legs (4). The inner surfaces (15*d*, 17*d*) of the outer rails (5*a*, 7*a*) are attached to the outer faces (13*b*) of the legs (3) of the first support frame (1) with spacers (9) therebetween. Similarly, the inner surfaces of the outer rails (6*a*, 8*a*) are attached to the outer surfaces (14*b*) of the legs (4) of the second support frame (2) with spacers (9) therebetween. The spacers (9) are sized and shaped to permit easy nesting of the two support frames (1, 2) by increasing the space between the outer and inner rails for receiving the legs (3) of the other support frame. The spacers may alternately be fastened between the inner rails of and the legs of each support frame, in addition to or in lieu of being fastened between the outer rails and the legs. While many methods of attachment are possible, each rail is preferably connected to the respective leg, with or without a spacer (9), with a single lag screw (20) and with an adhesive.

Figure 5:
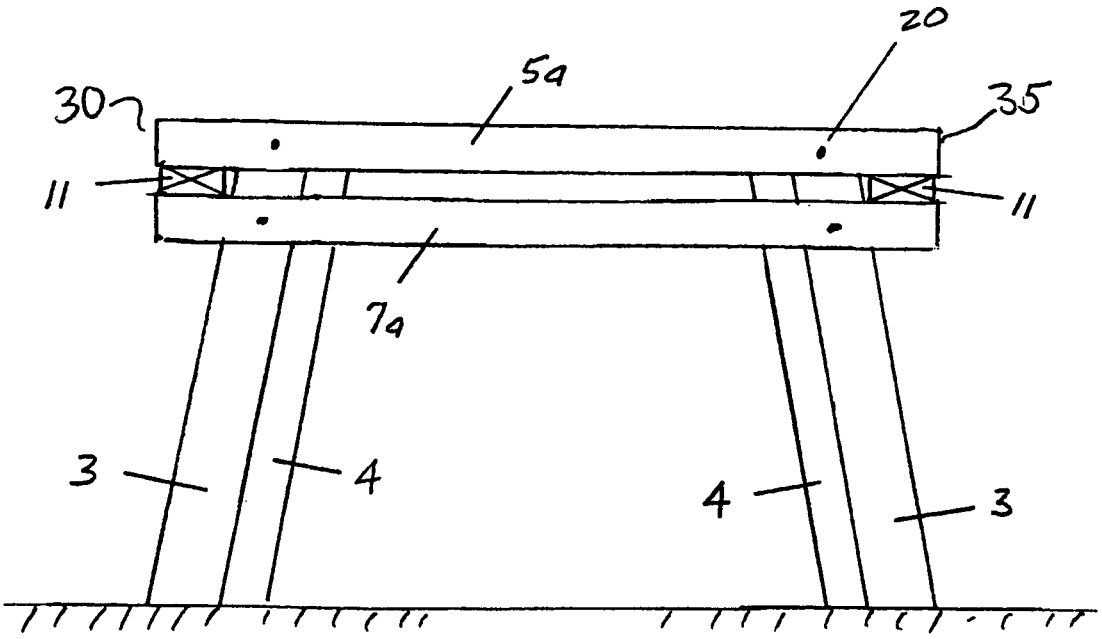
FIG. 5 is a side view of the support apparatus embodiment of FIG. 1.
Figure 6:
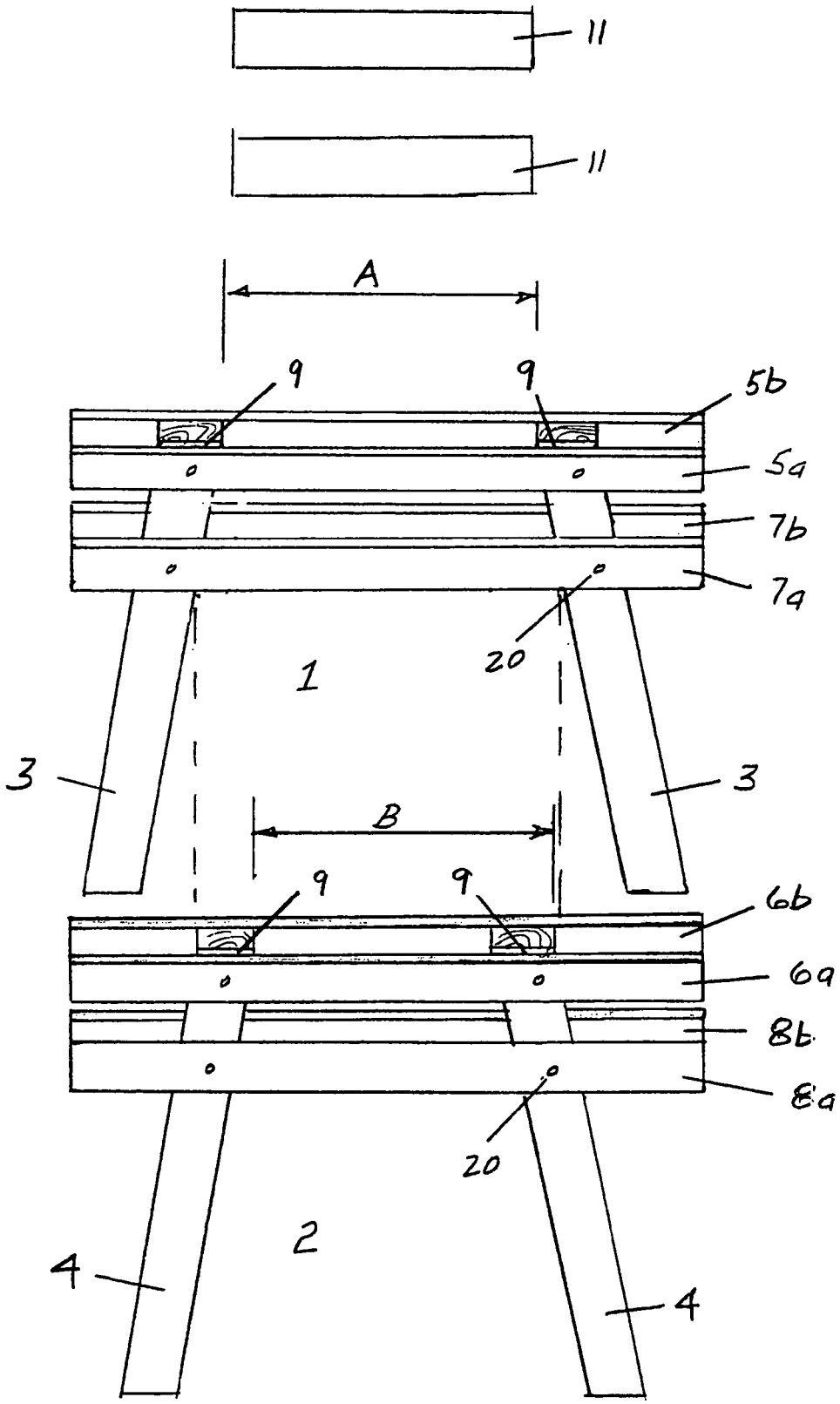
FIG. 6 is an exploded view illustrating two support frames and short linking members of a preferred embodiment of the support apparatus in proper alignment for easy nesting.
Figure 7:
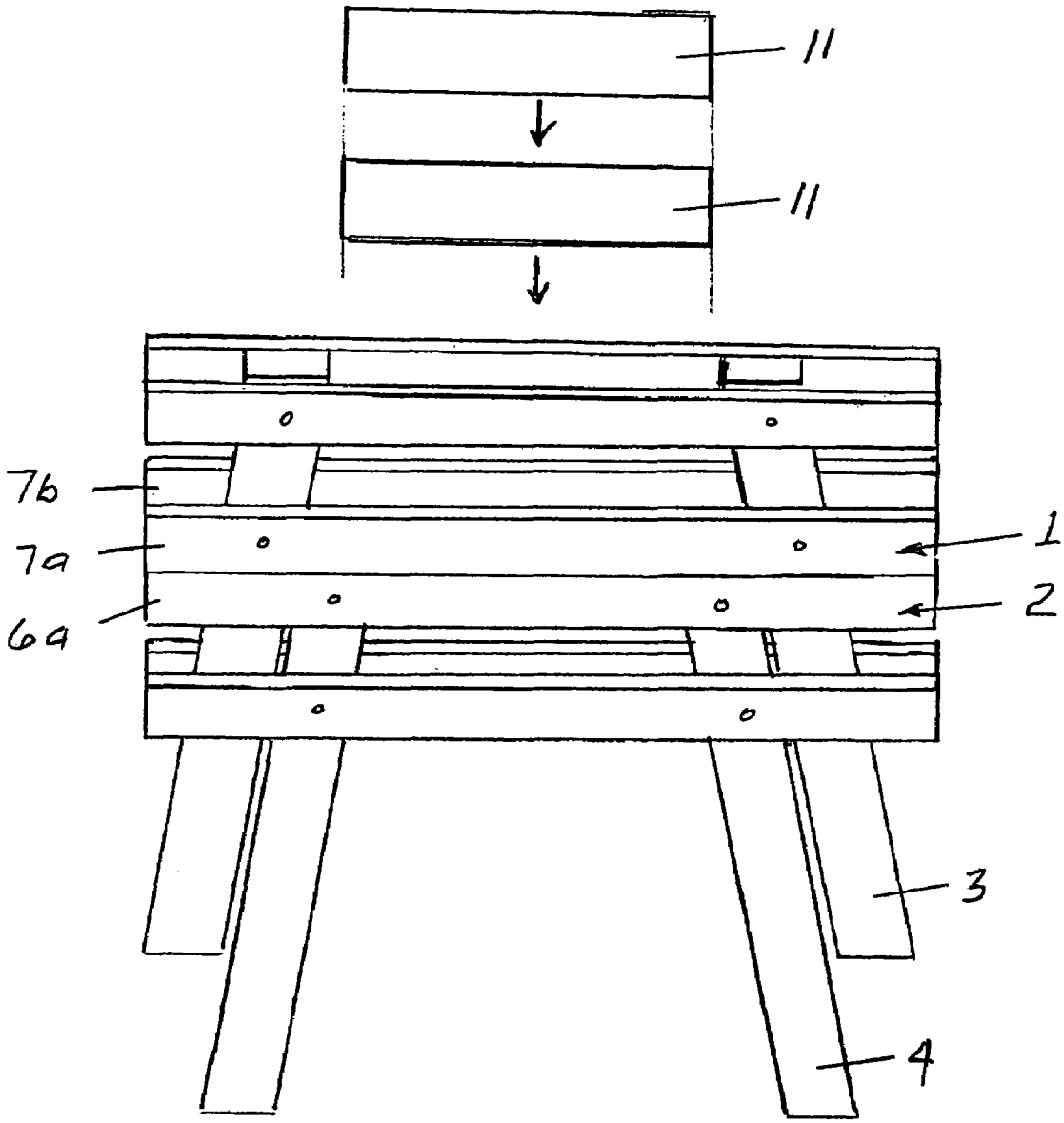
FIG. 7 is a side view of the two support frames of FIG. 6 nested together in a single unit, as well as two linking members in proper alignment for insertion into the single unit.
Figure 8:
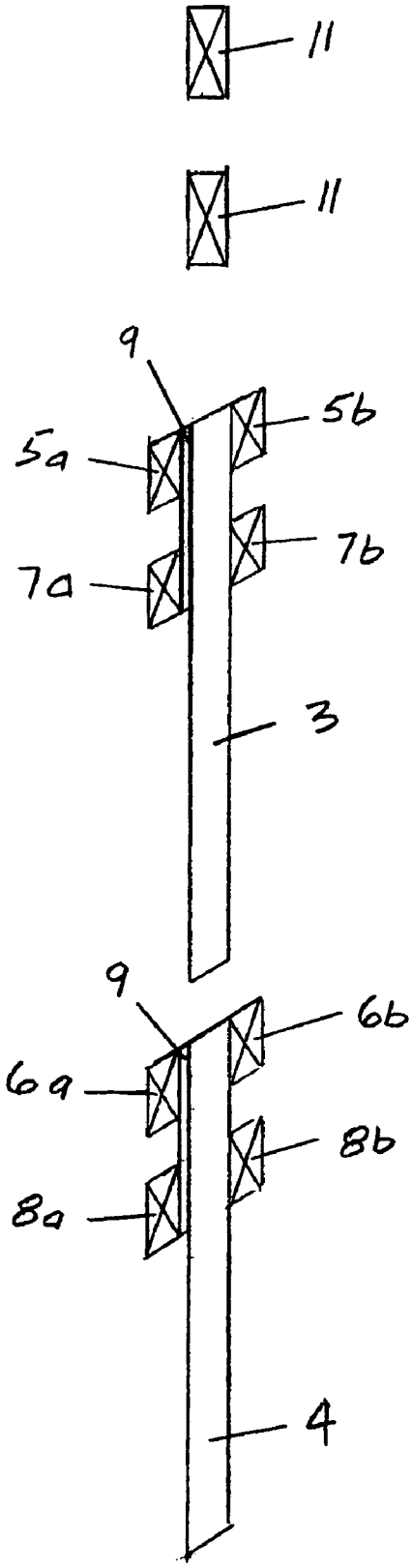
FIG. 8 is an exploded view illustrating two support frames and short linking members of a preferred embodiment of the support apparatus in proper alignment for nesting.
Figure 9:
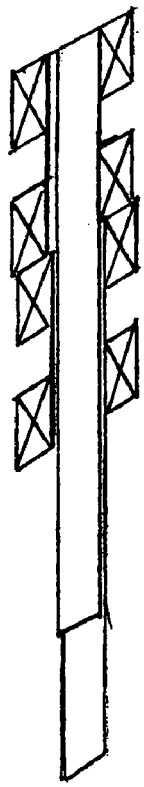
FIG. 9 is a front view of the two support frames of FIG. 8 nested together in a single unit.

As shown in FIGS. 5–7, legs (3) of the first support frame (1) may be positioned farther from each other along the rails (5*a*, 5*b*, 7*a*, and 7*b*) than the legs (4) of the second support frame (2) along the respective rails (6*a*, 6*b*, 8*a*, and 8*b*). Such an arrangement allows the legs (3) of the first frame (1) to be held outside of the legs (4) of the second support frame (2) when the two frames are nested together, as shown in FIG. 7. The difference in configurations between the two frames (1,2), e.g., the different leg positions, permits the first frame (1) to rest flush upon the second frame (2) when nested together. The bottom rails (7*a*, 7*b*) of the first frame (1) rest upon the top rails (6*a*, 6*b*) of the second sawhorse frame (2) to permit the combined unit to be carried easily by a user. Simultaneously, such a difference in leg positions is preferably minimized so that the legs of each frame may be spaced sufficiently widely to provide a stable base while also providing engagement means (30, 35) suitable to grip the linking members (11) securely.

Breaking down a support apparatus of the present invention to form a single nested unit may be accomplished quickly and easily. As shown in FIGS. 6–9, the linking members (11) are first removed from the engagement means (30, 35) of the support frames and may be set aside. Next, the first support frame (1) is lifted and positioned above the second support frame (2) such that the bottom ends of the legs (3) can slide down between the top rails (6*a*, 6*b*) and bottom rails (8*a*, 8*b*) and outside both legs (4) of the second support frame (2). The linking members (11) may then be nested with the support frames (1, 2). Such linking members preferably have lengths smaller than "A" and greater than "B" for easy and secure nesting, where "A" is the minimum distance between the upper surfaces of the legs (3) of the first support frame (1), and "B" is the minimum distance from the inside edge of the upper surface of one leg (4) of the second support frame (2) and to the outside edge of the upper surface of the other leg (4). Linking members (11) having the proper lengths may be securely nested into the cavity bound by the rails (5*a*, 5*b*, 7*a*, and 7*b*) and the legs (3) of the first support frame (1). The linking members (11) preferably have lengths greater than "B" to prevent them from falling-through the space between the legs (4) of the second support frame (2). Two such linking members may by easily and inconspicuously inserted into the nested unit.

The linking members are typically composed of nominally dimensioned 2×4 lumber, which has a thickness of 1.5". Therefore, the minimum space between the top rails (5*a*, 5*b*, 6*a*, and 6*b*) and their respective bottom rails (7*a*,7*b*, 8*a*, and 8*b*) is preferably slightly greater than 1.5" to facilitate easy insertion of the linking members (11) into the engagement means (30, 35).

A linking member (11) of virtually any length may be used. Longer linking members (11) enable greater spacing between the two support frames (1, 2). The support frames are held rigidly with respect to the linking members (11) and therefore with respect to each other. The rigid arrangement advantageously causes the top surfaces of the support frames (1, 2) to be held coplanar to each other with substantial stability. It can be appreciated that a single apparatus of the present invention typically provides conveniences and utilities greater than those achievable with two independent sawhorses, particularly when the ground is not level. Simultaneously, the present apparatus provides the ability to space the frames as far apart as desired, as is the case with sawhorses. While independent sawhorses can easily tip over, the linked frames of the present apparatus are more stable are more difficult to tip over.

The two support frames (1, 2) are typically erected whereby they lean inwardly towards each other, advantageously providing a "gripping" force couple when the erected apparatus is under a load. In addition, the frames may be erected to lean away from each other as shown, e.g., in FIGS. 10 and 11, while providing a similar "gripping" couple to the linking members. As shown in FIG. 11, additional support frames may be interconnected to provide a continuous series of aligned supports. The additional frames may alternately be arranged to provide an encircling configuration of supports, such as a square or circle, to accommodate workpieces of many shapes and sizes. For encircling or other curved configurations, the linking members preferably vary in length whereby the outer circumference of the configuration includes longer linking members and the inner circumference includes shorter linking members. In addition; the configurations my alternate where the linking members are positioned. Specifically, one segment of a configuration may include dual linking members disposed outside the legs of the frames, and the adjacent segment of the configuration may include a single linking member disposed between the legs of the frames.

As shown in FIG. 11, one or more additional support elements (A) may be conveniently placed upon the linking members (11) and held thereby. The additional support elements (A) are sized and shaped to include upper surfaces that are coplanar with upper surfaces of the integral support elements (21) and with the upper surfaces of the legs (3, 4). Importantly, the additional support elements (A) may be used to provide extra support to a workpiece and to support the workpiece fully both before and after it is cut. The user may space a plurality of additional support elements (A) by desired amounts for workpieces having a large variety of shapes and sizes. The vertical height of each additional support element (A) is preferably 2.25 inches to be rigid and to match the height of the integral support elements (21). The additional support elements (A) may be easily fabricated by combining one "2×" piece of lumber (having a height of 1.5 inches) and one "1×" piece of lumber (having a height of ¾ inches).

Figure 12:
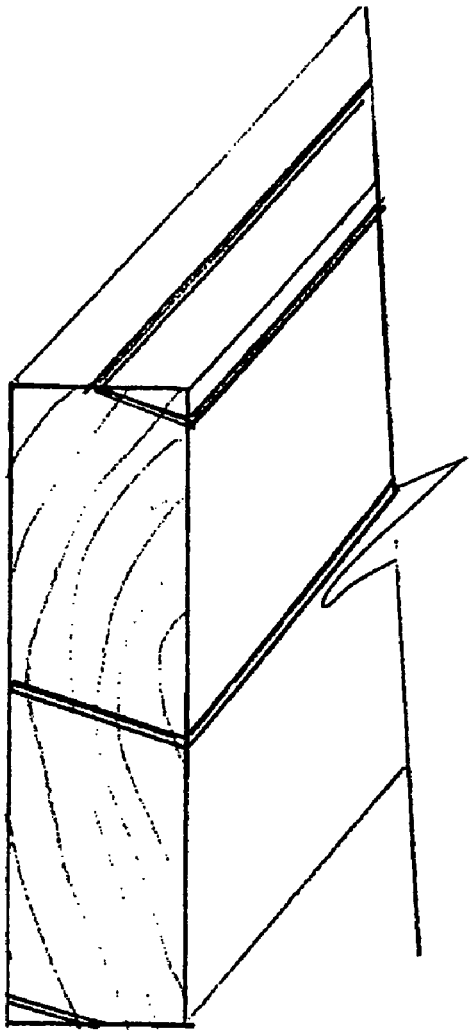
FIG. 12 is a perspective view of 2×6 lumber illustrating how two rails of a preferred embodiment of the support apparatus of the invention may be manufactured.
Figure 13:
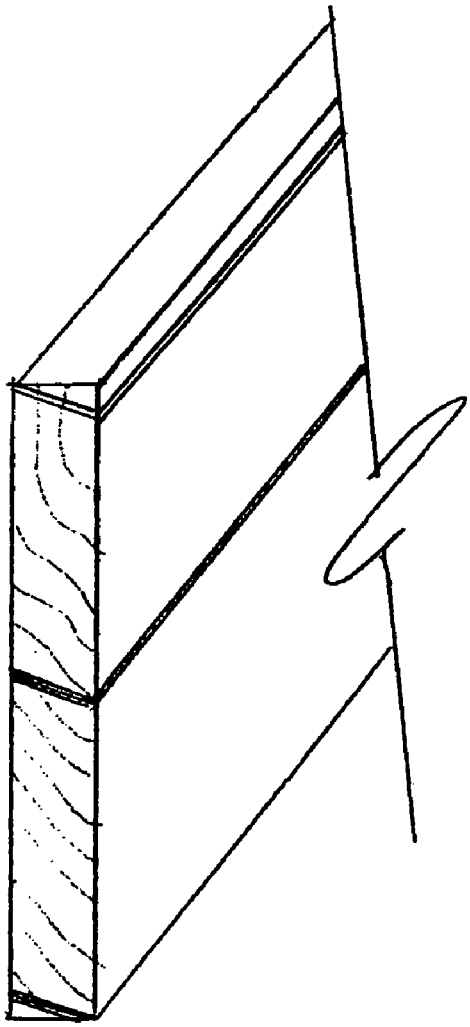
FIG. 13 is a perspective view of 1×6 lumber illustrating how two rails of an alternate preferred embodiment of the support apparatus of the invention may be manufactured.

As shown in FIGS. 12 and 13, two identical rails are preferably manufactured from a single piece of either 2×6 lumber or 1×6 lumber, in order to provide a 2.25 inch height above the linking members when the apparatus is erected. The height provides sufficient space to minimize the possibility of damaging either a tool or a linking member during a manufacturing operation (e.g., cutting a board with a circular saw). A piece is ripped lengthwise, e.g., on a table saw, to form a bevel cut in the upper and lower surfaces thereof. Subsequently, the piece is ripped in half lengthwise at an angle. When 2×6 lumber is used to impart extra rigidity to the rails, only a portion of each of the upper and lower surfaces is cut with a bevel cut in order to obtain the desired 2.25 inch height when the apparatus is erected.

Figure 14:
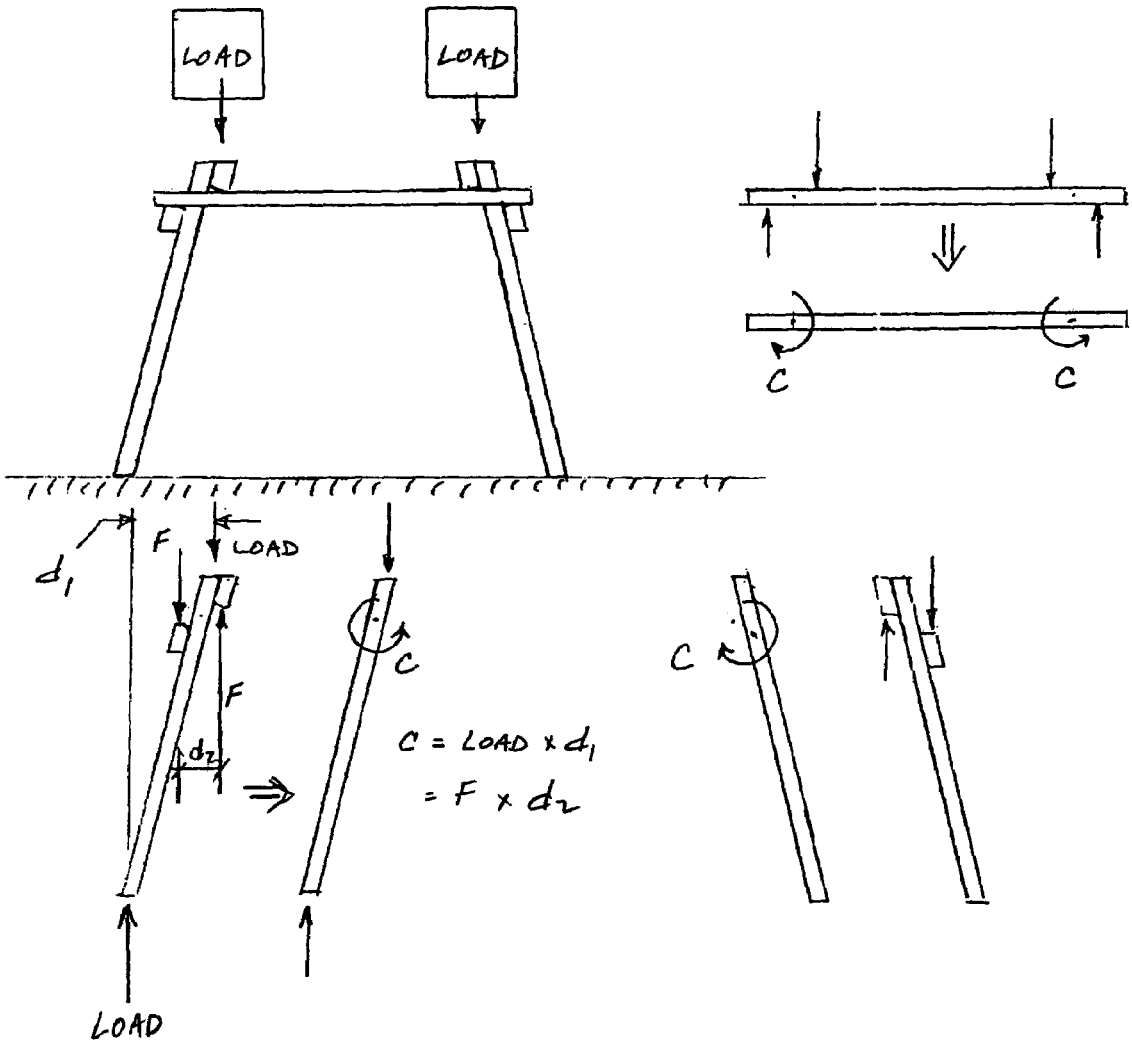
FIG. 14 is a schematic illustration of free body diagrams of components of a preferred support apparatus of the present invention, illustrating the resultant forces and couples from the application of loads proximate the support frames of an assembled apparatus.

As shown in FIG. 14, when a downward load is applied to either the sawhorse rails or the linking members (11), rotation of the support frames (1, 2) relative to the linking members is prevented by a force couple exerted by the linking members. The axis of rotation for the force couples passes through the middle of the legs (between the inner and outer surfaces thereof), is disposed centrally between the rails, and is parallel with the longitudinal axes of the rails. The maximum magnitude of the force couple is dependent upon the bending capacity of the linking member (11) which delivers the loads that cause the force couple to occur. Free body diagrams in FIG. 14 illustrate how the loads are applied both to the legs (3, 4) and to the linking members (11). The diagrams demonstrate how the current invention results in an equilibrium for both support frames (1,2).

Figure 15:
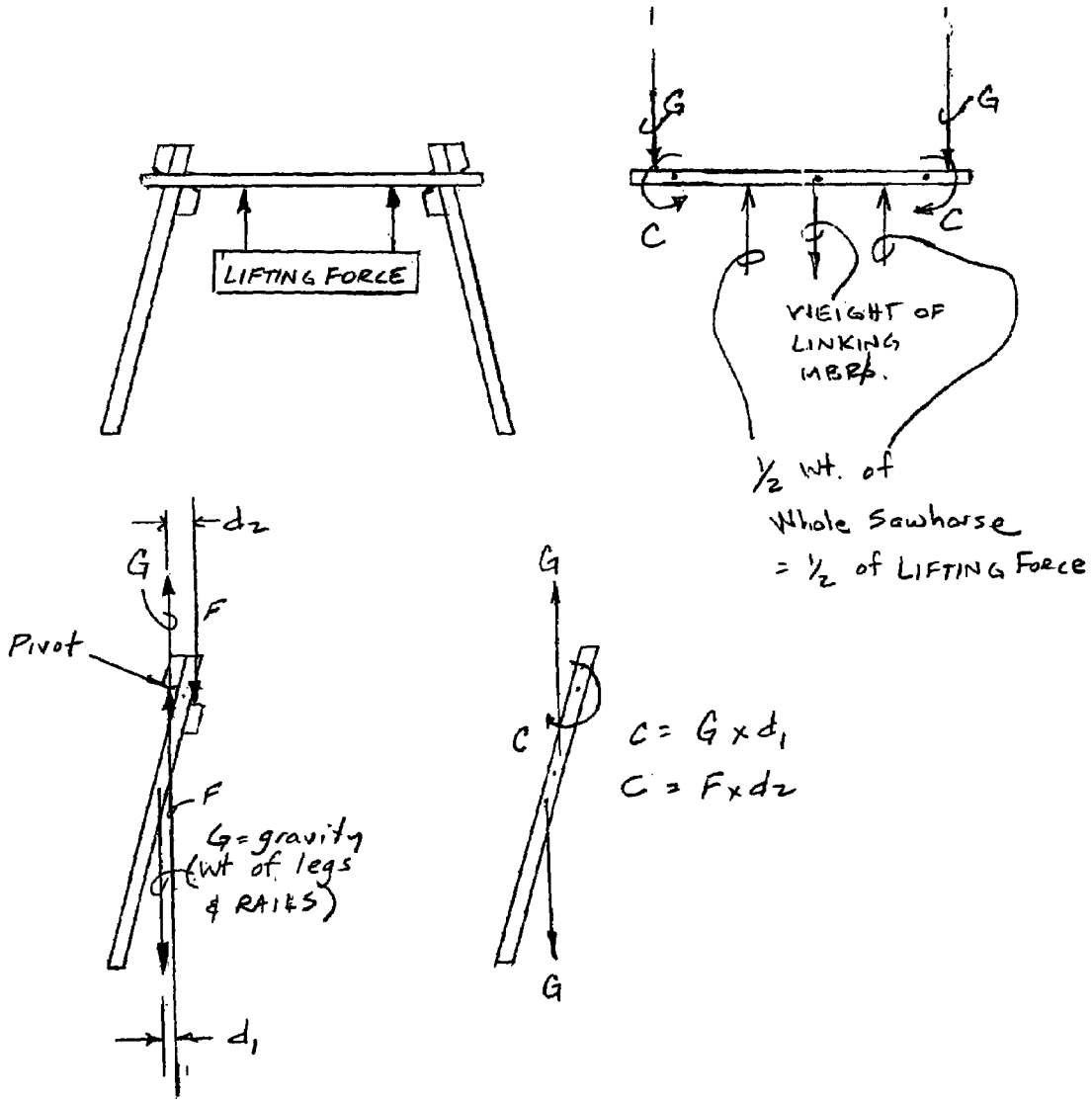
FIG. 15 is a schematic illustration of free body diagrams of components of a preferred support apparatus of the present invention, illustrating the resultant forces and couples from the application of a lifting force to the linking members of an erected support apparatus.

As shown in FIG. 15, when the apparatus of the present invention is lifted so the legs no longer touch the ground, a force couple is delivered to each leg (3, 4) by the linking members (11). The force couple causes each leg to remain fixed with respect to the linking members (11). The axis of rotation for this force couple is the same as the one above which acts on the legs when the sawhorse is in use, but the direction of the couple is opposite the one above. The force couple is applied to the legs (3, 4) by the linking members (11) by the upper, outside rails (5*a*, 6*a*) and the lower, inside rails (7*b*, 8*b*).

Figure 16:
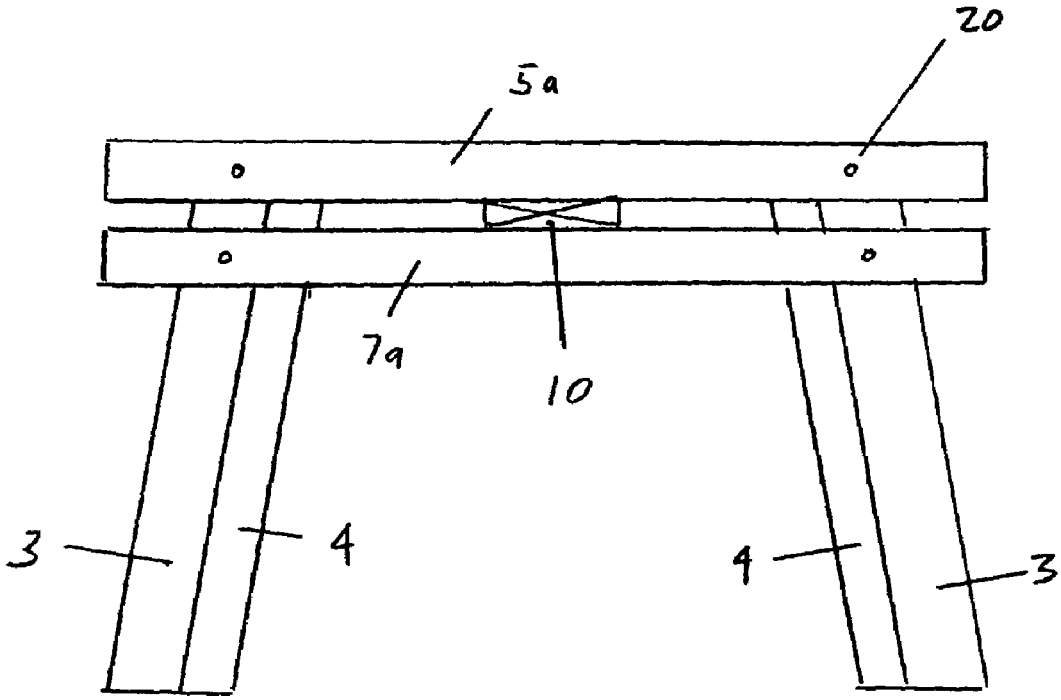
FIG. 16 is a side view of an alternate preferred embodiment of a support apparatus of the present invention assembled with a single linking member.

The present invention preferably uses two linking members (11) positioned outside of the legs (3, 4), as shown, e.g., in FIG. 1. However, the apparatus may alternately be erected with a single linking member (10) between the frames (1, 2). The single linking member (10) is preferably disposed between the legs of each support frame as shown in FIG. 16, rather than outside the legs thereof as is preferably the case with the dual linking members (11).

It is contemplated that the cross sectional shape of the rails, legs and linking members may vary substantially. If plastic or metal materials were substituted for wood, greater economy may be accomplished by using thin walled tubular shapes rather than solid sections. For proper functioning of the current invention, it is only necessary that the cross sectional shapes of the legs, rails and linking members provide sufficient bearing surface in the appropriate areas for contact between members.

Figure 17:
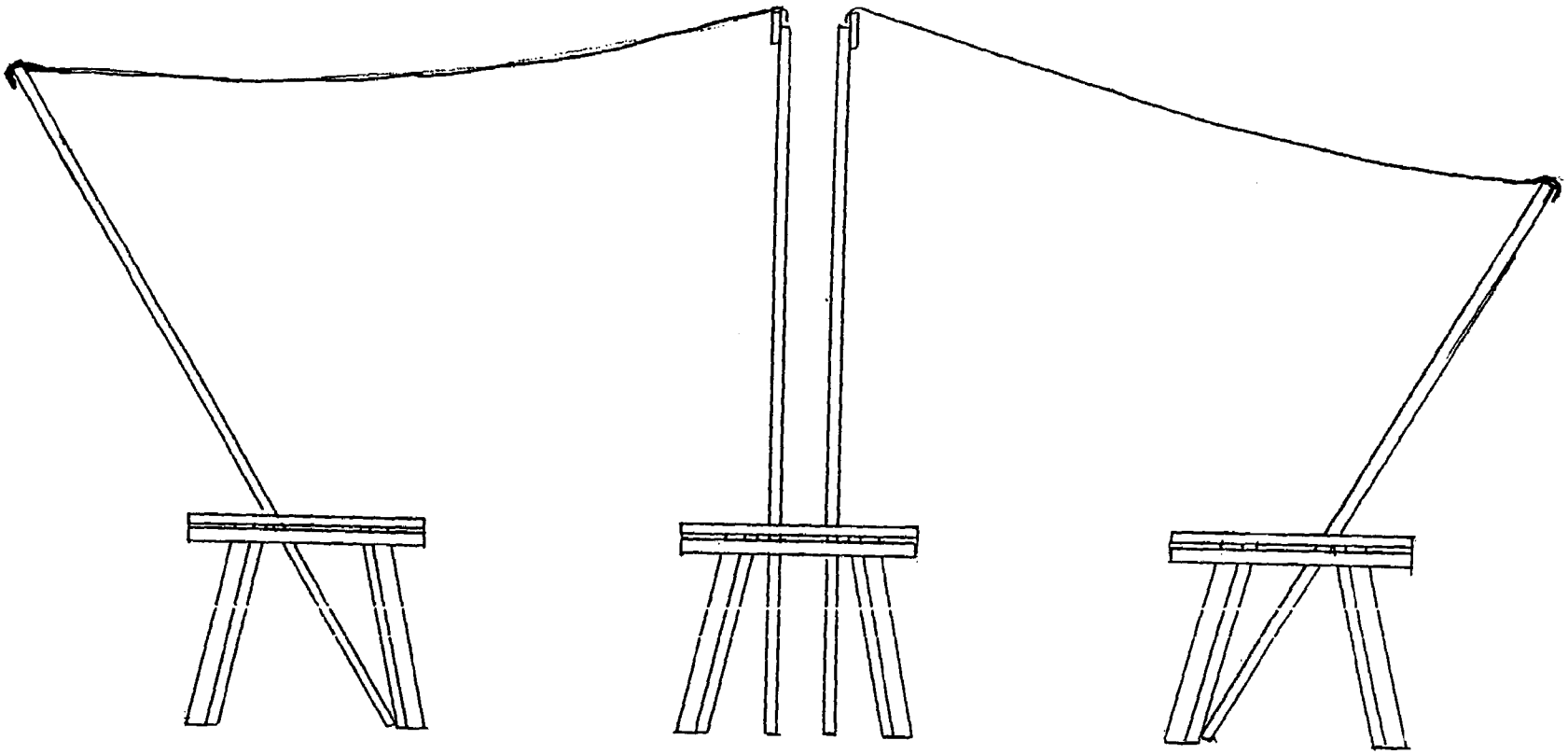
FIG. 17 is a perspective view of multiple support apparatuses of the invention shown with poles for providing a canopy.
Figure 18:
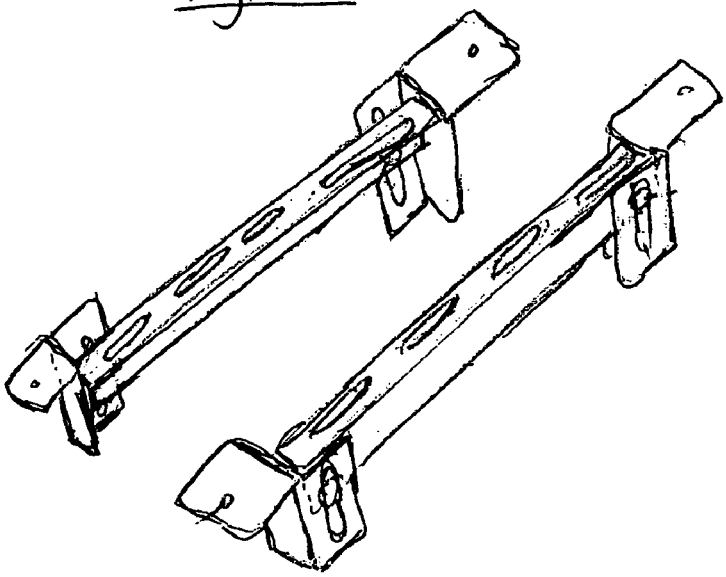
FIGS. 18–21 are perspective views of a tool frame stand that may be provided by the present invention.
Figure 19:
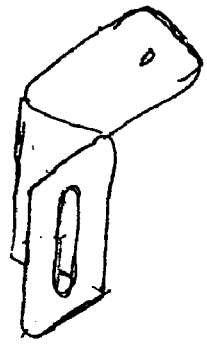
Figure 20:
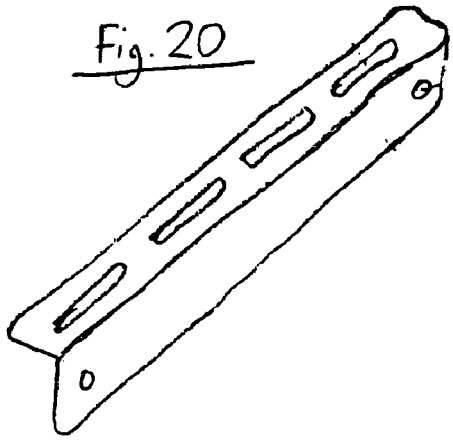
Figure 21:
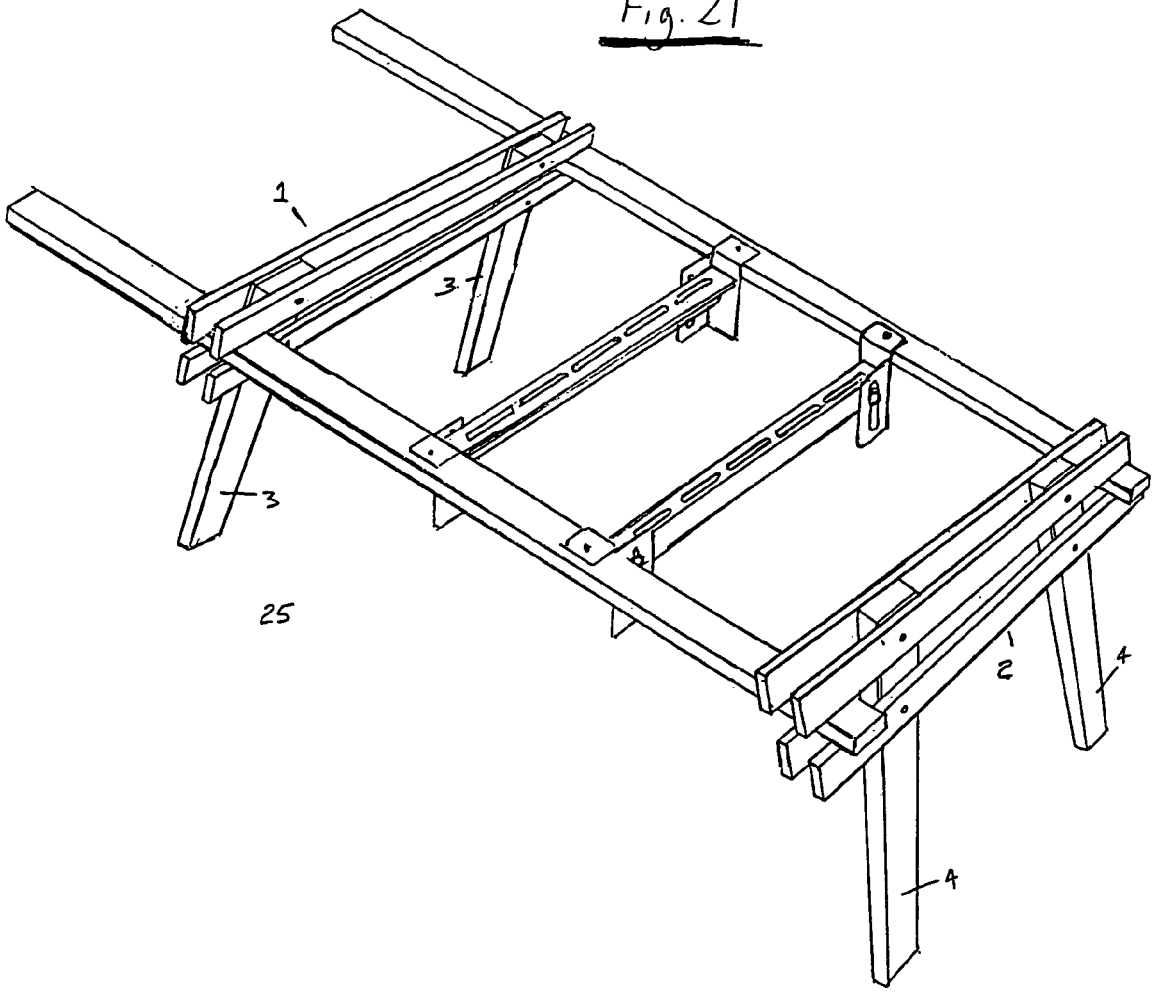

Additional features and uses are also contemplated in connection with preferred embodiments of the support apparatus of the present invention. As shown in FIG. 17, multiple support apparatuses may be used in combination to provide secure supports for a canopy or the like. The three apparatuses shown in FIG. 17 are preferably "duplicated," whereby there are three in front and three more in the rear for supporting a total of eight poles. The poles are secured between the support frames of each apparatus. A canopy may be conveniently fastened to the poles proximate the upper regions thereof.

As shown in FIGS. 18–21, a specially configured frame may be provided for securing a miter saw, table saw, or any of a variety of other power tools to the present apparatus. The frame attaches directly to the coplanar linking members to provide a planar surface on which a power tool may be placed. The power tool may be bolted to the frame or may simply rest thereon. The frame may also be bolted to the linking members for additional rigidity. As shown in FIGS. 18–21, the frame includes brackets which are preferably fixed to the linking members. Each of two braces is connected to and between two brackets by bolting or the like. To particular advantage, the level of each brace may be easily adjusted. Such adjustment permits the apparatus to support a power tool whereby the platform of the power tool is level with both the integral and additional support elements of the apparatus. Therefore, a user may more easily support a large workpiece upon the power tool because of the additional coplanar support provided by the present apparatus.

As shown in FIG. 22, a tool tray may be provided and may rest upon the linking members and between the support frames of the support apparatus. The tool tray may be held securely in place by providing apertures in the edges thereof. Dowel pins projecting upwardly from the upper surfaces of the linking members may be inserted into the tray apertures. The tool tray preferably has a bottom surface and four sidewalls. The tray may be installed with the bottom surface down to provide a tray with edges for preventing tools and the like from falling out of the tray. Alternately, the tray may be installed with the surface up to provide a solid upper surface, if desired, whereby the surface is level with the integral support elements of the apparatus. As a safety measure, a tarp strap or an alternate securing means may be attached on each to end to a support frame for pulling the frames together, in turn gripping the tool tray securely therebetween.

The improved apparatus of the present invention may also provide a portable scaffold. Specifically, a central linking member between two support frames may provide a platform for stepping, e.g., to reach higher elevations for residential painting or the like. In addition, two apparatuses can be arranged to provide scaffolding, whereby two first frames (1) are linked together and two second frames (2) are placed thereon, whereby the legs of each upper frame are insterted within the rails of the respective lower frame. The two upper frames may be linked together to provide a tall, interconnected platform for stepping.

It is contemplated that the present apparatus may provide the functions of a clamping means having elongated clamping surfaces with the addition of a common bar clamp. Specifically, an item to be clamped may be positioned between the two support frames, and the bar clamp may be used to squeeze the two frames together. Such a configuration advantageously provides a long vise for holding a workpiece or the like securely in place. The configuration may be used to provide an easel, wherein a canvas is secured between the support frames and rests upon short linking members. The canvas may be easily positioned and secured at an angle desirable for painting thereon.

A variety of manufacturing processes are contemplated in connection with the support apparatus. Rather than fabricate the devices from wood, an internal "rail framework" may be extruded with a die to form a configuration shown in FIG. 23. Rails, which may advantageously have rectangular cross sections, may be easily attached to a section of the extrusion by bolting or the like, and legs may be inserted into the extrusion from below. Using such an extrusion may preclude the need for using a fixture for assembling each frame. It is also contemplated that a mold may be used for forming each "rail framework" or a similar structure from plastic, whereby only the legs would need to be inserted therein in order to assemble a support framework. Each such structure preferably includes at least one integral supporting element above the engagement means.

It is also contemplated an entire apparatus may have three legs instead of four, e.g., where one of the frames has a centrally disposed leg rather than two legs. Such a configuration may provide additional stability on particularly irregular surfaces. It is also contemplated that each fram may include only two rails instead of four. Specifically, the first support frame (1) would include only rails 7*a* and 5*b*, and the second support frame would include only rails 6*b* and 8*a*. The resulting structure would be table when under load. However, the support frames would not be stable when raising the apparatus by applying a lifting force to its linking members. In another alternate embodiment, only a single rail needs to extend between the two legs of a support frame. Outside the legs, each frame may include separate engagement means, e.g., four rails, for assembling he apparatus. In yet another embodiment, an erected apparatus may include frames configured instead to be perpendicular with the linking members. While such an embodiment would not create "gripping" force couples proximate the engagement means when under a load, frictional forces at the engagement means may be sufficient to secure the apparatus in several applications.

The additional support elements (A) may comprise wider regions as well as narrower regions proximate the ends thereof. Specifically, the narrower regions may be sized and shaped so they may be inserted between the upper and lower rails of either support frame, while the wider regions are sized and shaped to provide an upper surface coplanar with the integral support elements when placed on the standard linking members (11). In such a configuration, the additional support elements may alternately provide, e.g., long linking members, whereby support elements having a height of 1.5 inch rather than 2.25 inches would be required to create a coplanar upper work surface with the integral support elements. To particular advantage, when the apparatus is nested, such additional support elements may be conveniently nested and held in place outside the legs of the top support frame (1) of the nested unit. A tarp strap may be wrapped around the periphery of the unit, as shown in FIG. 24. It can be appreciated that the tarp strap is positioned not only to hold the additional support elements securely in place but also to prevent separation of the two support frames from each other. Specifically, the tarp strap presses the additional support elements against the upper frame and prevents the tarp straps from moving with respect to the lower frame, in turn preventing the lower frame from moving with respect to the upper frame because hooks on the ends of the tarp strap abut against rails of the lower frame.

The dimensions of the erected apparatus may vary widely but preferably range from one foot to four feet in height and one foot to three feet in depth, where the width my range from approximately 0.5 foot to a very high number depending on the desired configuration. A user may bring frames up against each other to provide a relatively narrow work surface. When the frames are together, the footprint still remains relatively large because the legs advantageously project outwardly from each other. The apparatus provides a safe structure for standing and kneeling, e.g., if someone wishes to kneel upon a particularly large workpiece such as a panel while cutting it. If all four legs of the erected apparatus are not touching the ground, the apparatus may be moved easily as a single unit by a slight amount to try to provide a more stable footing. Alternately, the width may be varied slightly, or the frames may be positioned at slight angles relative to each other to provide a footprint that is not perfectly rectangular, also in order to try to provide a more stable footing.

Figure 10:
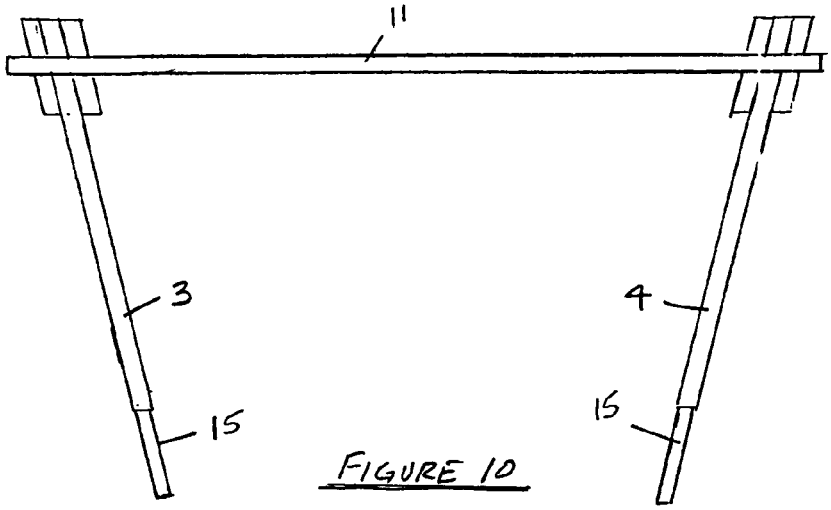
FIG. 10 is a front view of an alternate preferred embodiment of the support apparatus of the present invention, wherein the erected apparatus includes frames which lean away from each other, and wherein each frame includes telescoping leg sections for optional extension of the legs.
Figure 11:
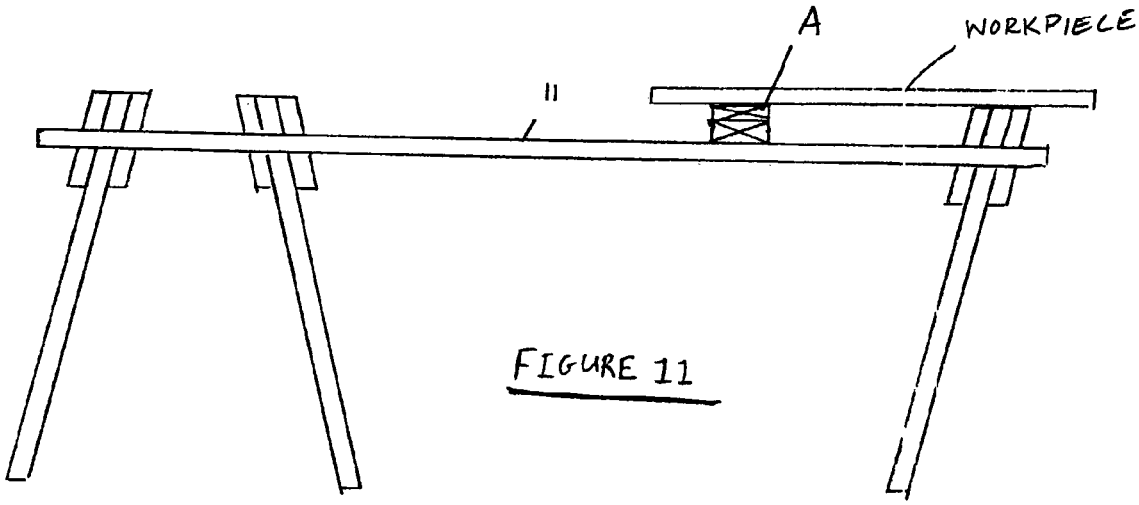
FIG. 11 is a front view of an alternate preferred embodiment of the support apparatus of the present invention including three support frames linked together, wherein an additional support element is advantageously positioned on the linking members to provide support for a workpiece.

As shown in FIG. 10, telescopic leg extensions (15) can be retracted into legs (3, 4) that are formed with cavities along their lengths in order to retain the telescoping extensions (15) for leveling purposes and to adjust the height of the apparatus.

While, in the foregoing, specific embodiments of the present invention have been set forth in considerable detail for the purpose of making a complete disclosure of the invention, it may be apparent to those skilled in the art that numerous changes can be made in such detail without departing from the spirit and principles of the invention.

I claim:

1. A modular support apparatus comprising:

(i) a first support frame;

(ii) a second support frame; and (iii) a linking member;

wherein each support frame has a lower region, an upper region, and at least one engagement means proximate the upper region thereof, wherein said linking member has a first end and a second end for engagement with the engagement means of the respective support frame, and whereby each end of the linking member is removable from the engagement means of the respective support frame, wherein each engagement means comprises inner and outer bracing means, the inner bracing means having an aperture aligned with an aperture of the outer bracing means, whereby the linking member is engaged by both bracing means of each of said engagement means simultaneously and in said apertures thereof.

2. The modular support apparatus of claim 1, wherein each support frame includes a front leg and a rear leg attached from and positioned internally between said inner and outer bracing means.

3. The modular support apparatus of claim 2, each support frame having front and rear engagement means, wherein said front engagement means of each support frame is positioned in front of the front leg, and wherein said rear engagement means of each support frame is positioned behind the rear leg.

4. The modular support apparatus of claim 3 comprising front and rear linking members, the front linking member being insertable into the front engagement means of each support frame in a rearward direction, and the rear linking member be insertable into the rear engagement means of each support frame in a forward direction.

5. The modular support apparatus of claim 4 further comprising at least one planar support element positioned upon top of said front and rear linking members, wherein an upper surface of said planar support element is coplanar with at least part of an upper surface of each support frame.

6. The modular support apparatus of claim 4, wherein each bracing means comprises upper and lower rails, whereby the linking member is positioned between said upper and lower rails of each bracing means.

7. The modular support apparatus of claim 4, wherein the front and rear legs protrude from said upper region of each support frame downwardly and outwardly away from each other, wherein the spacing between said front and rear legs of the first support frame is greater than the spacing between said front and rear legs of the second support frame, whereby the legs of the first support frame are insertable between the bracing means of the second support frame to form a nested unit.

8. The modular support apparatus of claim 1 further comprising at least one planar support element positioned upon top of said linking member, wherein an upper surface of said planar support element is coplanar with at least part of an upper surface of each support frame.

9. The modular support apparatus of claim 1, wherein the support apparatus is on solid ground, wherein the lower region of each support frame has a base for contacting the ground, wherein the distance between said base of the first support frame and said base of the second support frame is greater than the distance between the engagement means of the first support frame and the engagement means of the second support frame, whereby the application of a downward force to the support apparatus causes at least one of said engagement means to apply a gripping couple to the linking member, whereby said gripping couple restricts the motion of the linking member with respect to said at least one engagement means.

10. In a sawhorse structure, the improvement comprising first and second support frames and a linking member, wherein the first support frame has a first engagement means and the second support frame has a second engagement means, wherein the linking member is attached from said first and second engagement means, whereby the distance between the support frames may be altered without tools, wherein each of said first and second engagement means comprises inner and outer bracing means, the inner bracing means having an aperture aligned with an aperture of the outer bracing means, whereby the linking member is engaged by both bracing means of each said engagement means simultaneously and in said apertures thereof.

11. The improved sawhorse structure of claim 10, said bracing means of each support frame providing front and rear engagement means, wherein the improved sawhorse structure comprises front and rear linking members, wherein the front linking member may be inserted into the front engagement means of each support frame, and wherein the rear linking member may be inserted into the rear engagement means of each support frame.

12. The improved sawhorse structure of claim 11, wherein each support frame includes a front leg and a rear leg attached from and positioned internally between said inner and outer bracing means, wherein the front and rear legs protrude downwardly and outwardly away from each other, and wherein the spacing between the legs of the first support frame is greater than the spacing between the legs of the second support frame, whereby the legs of the first support frame may be inserted between the bracing means of the second support frame to form a nested unit.

13. The improved sawhorse structure of claim 11 further comprising at least one planar support element positioned upon top of said front and rear linking members, wherein an upper surface of said planar support member is coplanar with at least part of an upper surface of each support frame.

14. The improved sawhorse structure of claim 10 further comprising at least one planar support element positioned upon top of said linking member, wherein an upper surface of said planar support member is coplanar with at least part of an upper surface of each support frame.

15. The improved sawhorse structure of claim 10, wherein the sawhorse structure is on solid ground, wherein the lower region of each support frame has a base for contacting the ground, wherein the distance between said base of the first support frame and said base of the second support frame is greater than the distance between the first engagement means and the second engagement means, whereby the application of a downward force to the sawhorse structure causes at least one of said engagement means to apply a gripping couple to the linking member, whereby said gripping couple restricts the motion of the linking member with respect to said at least one engagement means.

16. A support frame comprising:

(i) front and rear legs, each leg having an upper region and a lower region;

(ii) a first pair of parallel upper and lower rails attached to the front and rear legs proximate the upper regions thereof; and (iii) a second pair of parallel upper and lower rails attached to the front and rear legs proximate the upper regions thereof;

wherein the front and rear legs are positioned internally between said first and second pairs of rails.

17. The support frame of claim 16, wherein the spacing between the lower regions of the front and rear legs is greater than the spacing between the upper regions of the front and rear legs, whereby the support frame has front and rear engagement means wherein said front engagement means is positioned in front of the front leg and said rear engagement means is positioned behind the rear leg, and whereby the lower regions of the legs are spaced to provide sufficient fore and aft stability to the support frame.

* * * * *